US009038537B2

(12) United States Patent
Aylward et al.

(10) Patent No.: US 9,038,537 B2
(45) Date of Patent: May 26, 2015

(54) METHOD AND SYSTEM FOR APPLYING CUSTOMER-SPECIFIC LABELS TO UNPRINTED SIDE OF PRINTED PRODUCTS

(75) Inventors: James R. Aylward, Arlington, MA (US); Anthony A. Breen, Walpole, MA (US)

(73) Assignee: Vistaprint Schweiz GmbH, Winterhur (CH)

( * ) Notice: Subject to any disclaimer, the term of this patent is extended or adjusted under 35 U.S.C. 154(b) by 465 days.

(21) Appl. No.: 13/099,356

(22) Filed: May 2, 2011

(65) Prior Publication Data

US 2012/0279409 A1 Nov. 8, 2012

(51) Int. Cl.

| | |
|---|---|
| ***B41J 11/66*** | (2006.01) |
| ***B65B 61/26*** | (2006.01) |
| ***B65B 61/20*** | (2006.01) |
| ***B41J 3/01*** | (2006.01) |

(52) U.S. Cl.

CPC ..... *B41J 11/66* (2013.01); *B65B 61/20* (2013.01); *B41J 3/01* (2013.01)

(58) Field of Classification Search

CPC ..... B41F 33/00; B41F 17/00; B65B 61/00; B65B 61/20; B65B 61/202; B41J 11/66

USPC ..... 101/483

See application file for complete search history.

(56) References Cited

U.S. PATENT DOCUMENTS

| | | | | |
|---|---|---|---|---|
| 7,243,842 | B1 | 7/2007 | Leon et al. | |
| 2003/0025779 | A1 * | 2/2003 | Miyazaki | 347/171 |
| 2004/0007868 | A1 * | 1/2004 | Werling | 283/67 |
| 2005/0063680 | A1 * | 3/2005 | Kito | 386/117 |
| 2006/0096142 | A1 * | 5/2006 | Chen et al. | 40/717 |
| 2009/0116893 | A1 * | 5/2009 | Furuki et al. | 400/621 |
| 2010/0119756 | A1 * | 5/2010 | Kahler et al. | 428/40.1 |
| 2012/0084222 | A1 * | 4/2012 | Zimberoff et al. | 705/330 |
| 2012/0134735 | A1 * | 5/2012 | Kobayashi | 400/621 |

OTHER PUBLICATIONS

"Notification of Transmittal of the International Search Report and the Written Opinion of the International Searching Authority, or the Declaration," mailed Aug. 9, 2012 for International Application No. PCT/US2012/036101.

* cited by examiner

*Primary Examiner* — David Banh
(74) *Attorney, Agent, or Firm* — Jessica Costa

(57) ABSTRACT

Systems and methods for applying customer-specific labels to an unprinted or non-displayed side of printed products.

11 Claims, 12 Drawing Sheets

METHOD AND SYSTEM FOR APPLYING CUSTOMER-SPECIFIC LABELS TO UNPRINTED SIDE OF PRINTED PRODUCTS

BACKGROUND OF THE INVENTION

The present invention relates generally to tracking orders in production, and more particularly to techniques for applying customer-specific labels to an unprinted side of printed products.

Vendors of fine printed products traditionally manufactured printed products on offset printers by printing long runs of the same print job. Each print job required an expensive and time-consuming setup process, involving the separation of colors of the document into primary ink colors (such as Cyan, Magenta, Yellow, and Black), creation of aluminum printing plates for each ink color, and mounting and setup of the aluminum printing plates in the printing press. Traditionally, each print job corresponded to a document ordered by a single customer. Orders were tracked by print job and were simple to track because only a single print job was printed at a time, and each print job required physical setup of the printing press.

With the increasing preference of customers to shop online, at least one web-based customized printed product vendor (namely, www.vistaprint.com) now allows a customer to order small or large quantities of customer-personalized printed products. Vistaprint.com may aggregate the orders of personalized printed products from multiple customers into a single print job to achieve enhanced performance advantage by reducing or eliminating the setup time required between individual customers' print jobs. When large numbers of a customer's product is ordered, for example 250 business cards, the customer's business card design may be aggregated with hundreds of other customers' business designs into a composite print job, whereby each of the individual customers' designs are arranged and printed onto a single sheet of substrate. The print job is run to print 250 sheets. The stack of 250 printed sheets may then be cut into individual stacks of 250 business cards, each stack containing 250 identical business cards corresponding to the same customer, and each individual stack potentially corresponding to a different customer.

For orders of large quantities of small products (such as business cards or other printed products in which multiple designs may be simultaneously printed on a single substrate), customer orders may be tracked by keeping track of the position of the customer's design in the composite print design.

For orders of small quantities of larger products, such as orders of banners and posters in single-digit quantities (such as 1 or 2), order tracking becomes more difficult. One way of tracking a particular customer's order is to print an identifier such as a barcode together with the design. Because customers of fine printed products do not desire to have a barcode integrated into the design to be printed, the barcode (or other identifier) may be printed outside the printed design area. However, customers do not desire to receive a printed product that requires trimming.

Accordingly, it would be desirable to have a technique for printing and associating a barcode or other identifier unique to a customer or customer order, and allowing the barcode to stay with the product without requiring the customer to trim the product upon receipt of the product.

SUMMARY

The present invention is directed at techniques for applying customer-specific labels to an unprinted or non-displayed side of printed products.

In an embodiment, a method for applying customer-specific labels to an unprinted side of printed products includes receiving a product design identifier corresponding to a customer's customized product design, printing the customer's customized product design in a no-trim area on a substrate, printing the product design identifier associated with the customer's customized product design on the substrate in an area outside the no-trim area, and prior to trimming away the no-trim area, scanning the identifier and printing a corresponding label containing customer order information and affixing the label to a different side of the substrate within the no-trim area of the printed design.

BRIEF DESCRIPTION OF THE DRAWINGS

A more complete appreciation of this invention, and many of the attendant advantages thereof, will be readily apparent as the same becomes better understood by reference to the following detailed description when considered in conjunction with the accompanying drawings in which like reference symbols indicate the same or similar components, wherein.

DETAILED DESCRIPTION

Aspects of the invention include machines and methodologies for tracking customer orders of small quantities of printed products by applying customer-specific labels to an unprinted side of the ordered printed products.

It will be understood that, while the discussion herein describes applications of the invention to the printing of small quantities of customer-unique posters or banners, the invention is not so limited and is relevant to any application for tracking customer-specific orders of printed products.

Figure 1:
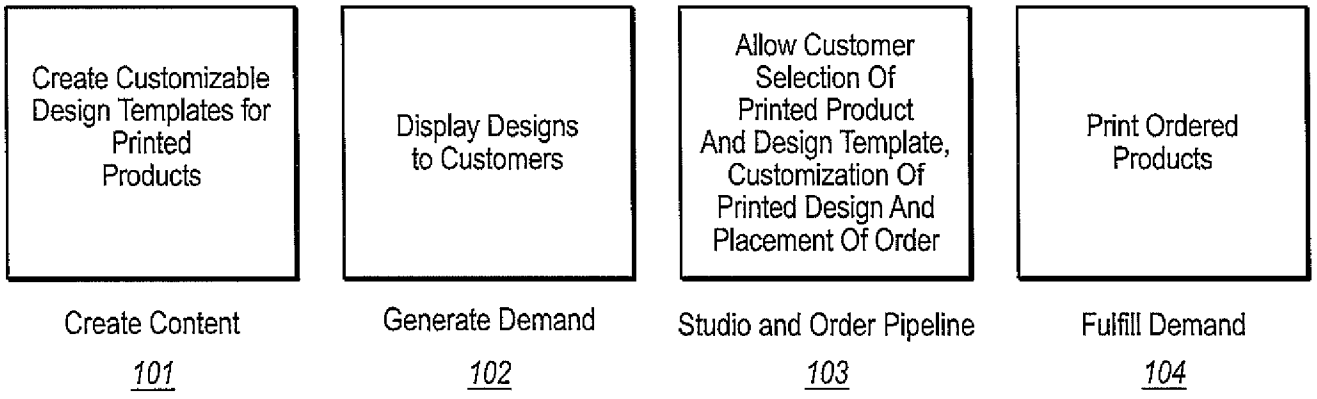
FIG. 1 is a high-level flow diagram illustrating an online retail model.

FIG. 1 shows a high-level flow diagram illustrating a model for offering, selling and producing printed products containing various customized designs/patterns through a computerized environment. The model includes a Create Content component 101 whereby content such as designs, graphics, templates, etc. which may later be offered as, or incorporated into a customer's customized and personalized designs to be printed are created or otherwise obtained. The model further includes a Generate Demand component 102 through which customer interest in printed products incorporating the content is generated. The Generate Demand component 102 may comprise, for example, web pages of an online retailer's website that display one or more products that can be printed and various designs that may be printed on the products that are available for ordering by a customer. The model further includes an Order Pipeline component 103 through which a product to be printed is selected and customized by a customer and an order for the printed product is placed. In an online retailer's website, the Order Pipeline component 103 may comprise design tools, discussed hereinafter, that allow the customer to select a product design template and to customize text and/or graphical components of the design prior to ordering one or more products printed with the design.

The model further includes an Order Fulfillment component 104 which accepts orders from the Order Pipeline component 103 and prints and ships the orders to the customers. In an embodiment, the Order Fulfillment component 104 is a printing facility which prints the ordered items with the design specified in a customer's order.

In an embodiment, each of the Create Content component 101, the Generate Demand component 102, the Order Pipeline component 103, and Order Fulfillment component 104 is implemented at least in part using one or more computer systems, for example as illustrated and discussed in connection with FIG. 9.

Figure 2:
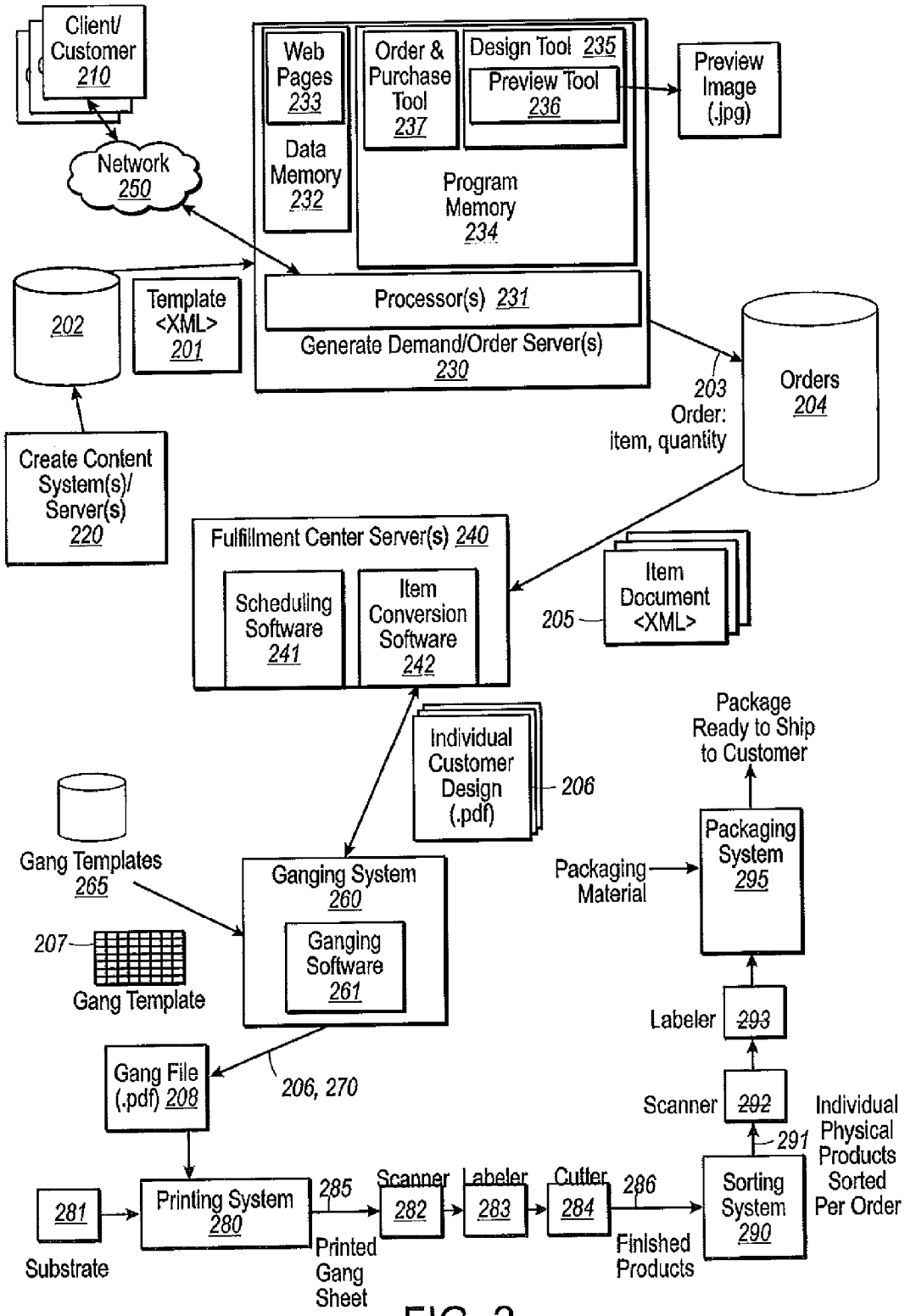
FIG. 2 is a high-level block diagram of an online retail system for customizing and printing articles of manufacture.

A system embodying the model of FIG. 1 is shown in FIG. 2. A Create Content system 220, which may be implemented with one or more computer systems or servers (for example as described hereinafter in conjunction with FIG. 11), is used to receive, obtain, generate, and/or otherwise provision a Content database 202 with content such as template descriptions and associated design descriptions usable by one or more Generate Demand I Order Pipeline servers 230 to customize and specify customer printed product orders. One or more computer systems (for example as described hereinafter in conjunction with FIG. 9) implement the Generate Demand I Order Pipeline servers 230 to serve pages of an online retailer website in order to generate orders 204 from customers for articles of manufacture to be printed. In an embodiment, the articles of manufacture may be printed with designs customized and/or personalized by the customer. For example, the article of manufacture may be a business card design customized with a customer-selected layout, color scheme, font attributes and graphics, and further containing personalized, text and/or graphics. In another embodiment, the article of manufacture may be a banner or poster containing a customer's design. Orders 204 are received by one or more Fulfillment Center server(s) 240 and filled and printed according to the specifications of the order.

Each of the Create Content component 101, the Generate Demand component 102, the Order Pipeline component 103, and Order Fulfillment component 104 described in FIG. 1 requires its own implementation considerations. Turning first to the Create Content component 101, the Create Content component 101 encompasses the implementation of content that corresponds to templates and designs that can be edited and personalized by remote customers over a network 201 (FIG. 2) such as the Internet (and then subsequently ordered as engraved articles of manufacture). For any given article of manufacture offered by the vendor, one or more templates are generated by a human designer (typically operating a design tool 214 implemented as software executed by one or more computer processors such on one or more servers 220), or alternatively, a template may be designed and generated automatically by software.

Figure 3:
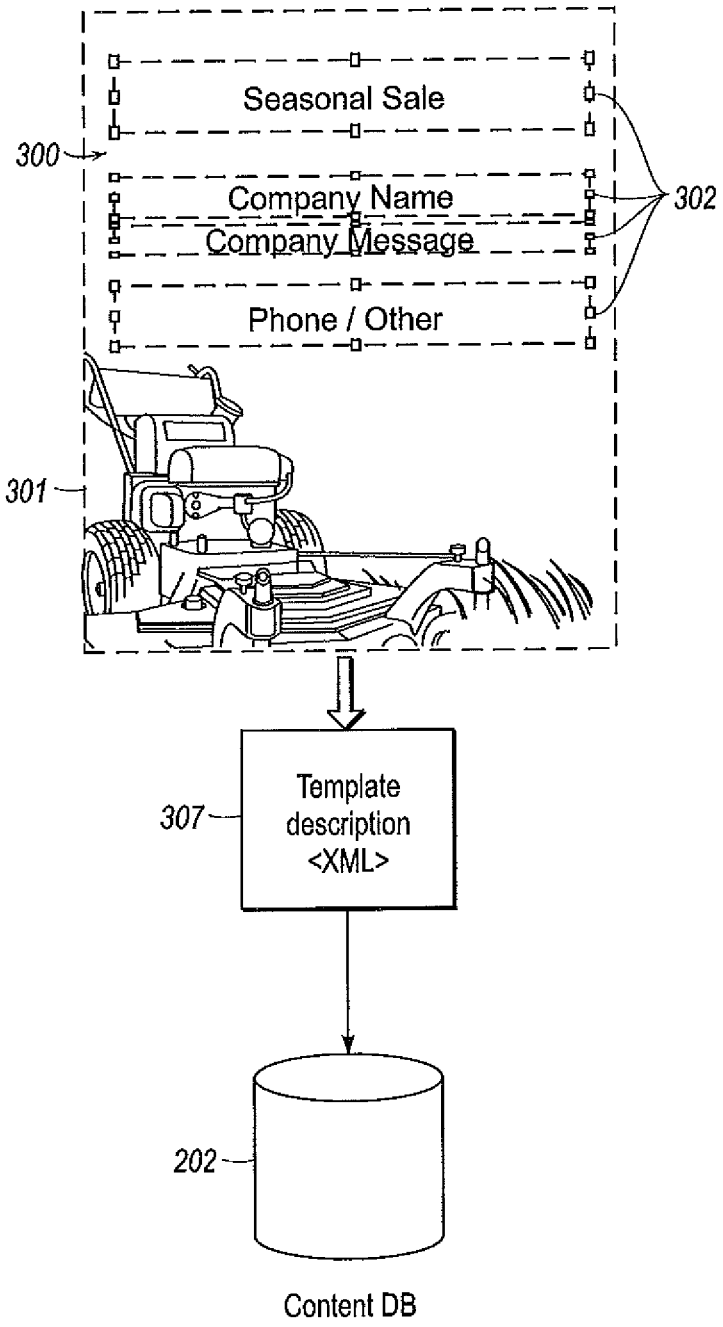
FIG. 3 is an operational diagram illustrating a design template.

FIG. 3 shows an example poster template 300. As illustrated, a template 300 may include a graphic 301 (in this case lawn mower and yard design) and one or more editable content areas 302 that allow a customer to personalize the design with their specific information. For example, a template 300 for a poster as shown in FIG. 3 may include a non-editable graphic 301 and one or more editable text containers 302 which can be edited by a customer to fill in their own text.

Each article of manufacture is printed in a targeted printing area of predefined dimensions. In an embodiment, the components 301 and 302 are combined with a layout component that defines the positions of each of the components within an area corresponding to a targeted printing area of a particular article of manufacture. For example, if the article of manufacture is a poster, the targeted printing area dimensions may be of a predefined size (for example, 12×18 inches, 24×36 inches, etc.). The template 300 is described in a template description 307 and is stored in a content database 202 preferably in a markup language format such as eXtensible Markup Language (XML) that can be processed by a web browser to render an image of the template on a computer display screen.

The stored content 202 (i.e., template description files 307 and associated components 301, 302) may be provisioned to a server 230 hosting a website. In one embodiment, as illustrated in FIG. 2, the Generate Demand/Order pipeline server 230 serves web pages 233 implementing the retailer's website to customers operating client computer systems 210. A customer interacts with the website through a browser 213 executing from program memory 212 under the control of one or more processors 211. The design and order process is conducted through the website.

Figure 4A:
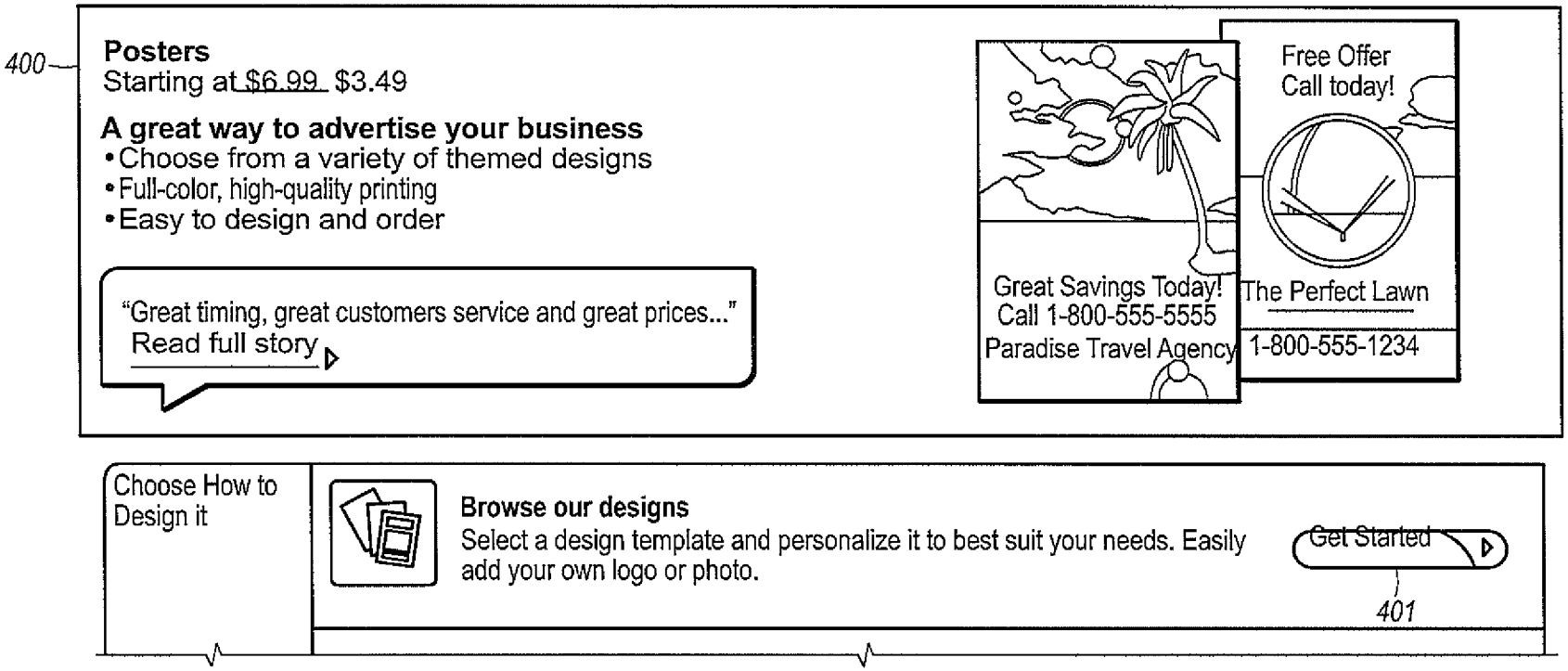
FIGS. 4A-4E illustrates exemplary web pages displayed to a customer during selection and customization of an engraving design to be engraved on a product.
Figure 4B:
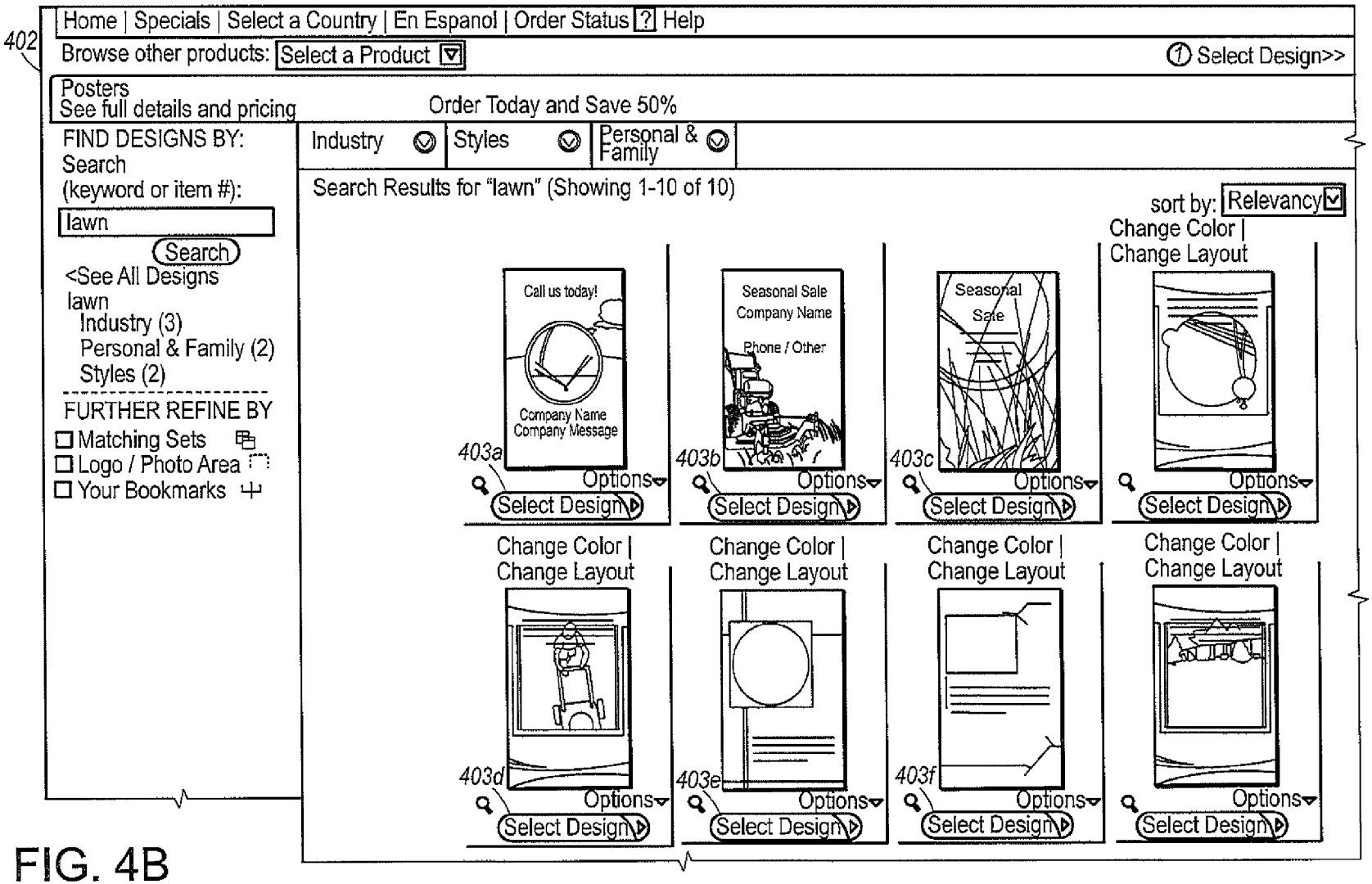

FIGS. 4A-4G illustrate a sequence of web pages 233 that may be presented to a customer and served by the Order server(s) 230 during the process of ordering a customized poster by a customer operating a client computer 210. FIG. 4A shows an introductory web page 400 advertising the posters and inviting the customer to browse designs, via link 401, that may be printed as a poster. FIG. 4B shows a gallery of designs that may be selected by the customer to print as a poster. Design templates that include customizable text are shown with sample text content to represent how the design will look when printed as a poster. The customer may select one of the designs by clicking on a corresponding link 403*a*, 403*b*, 403*c*, 403*d*, 403*e*, 403*f*.

Figure 4C:
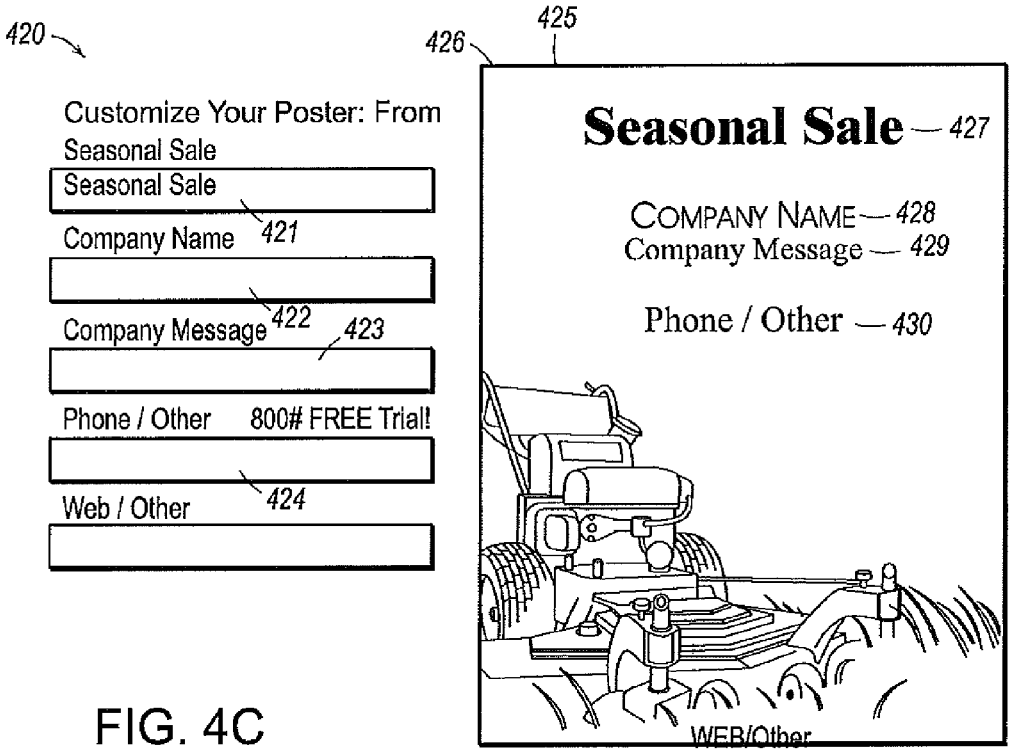
Figure 4D:
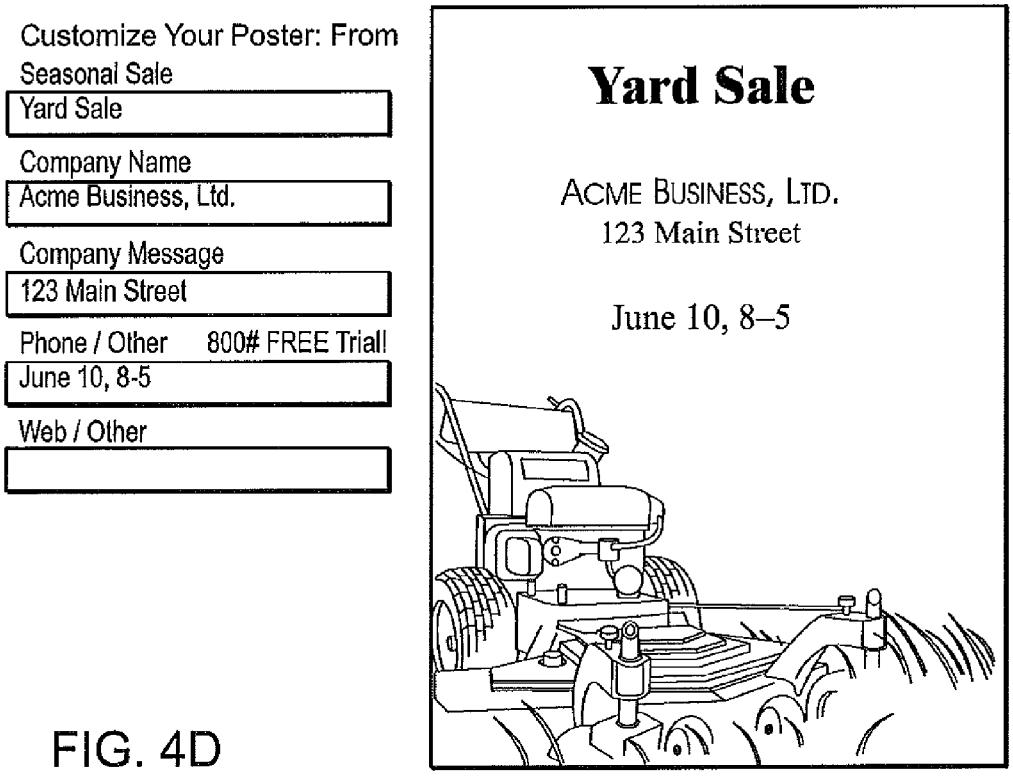

FIG. 4C shows a web page 420 presented to a customer after the customer has selected one of the design templates (via link 403*f*) from the gallery. In the example shown, the customer has selected design template having a graphical design (yard and lawn mower design) 426 and customizable text fields 427-430 to allow the customer to insert a company name, individual name, Job Title, and Phone/Web address (or other text) specific to the customer. The web page 420 includes an image of a poster 425 printed with the sample text and graphical image. The web page also includes text entry boxes 421-424 where the customer can enter text to replace the sample text. FIG. 4D shows the web page 420 presented to the user after the user has inserted text for the company name, individual name, job title, and web/other field into the corresponding text entry boxes 421-424.

As illustrated, in this embodiment, the image of the printed poster has been updated to show how the poster will appear as the final product. In an embodiment, the user-inserted text in the text entry boxes 421-424 is returned to the server for conversion to an image and returned to the client computer for display in the user's browser. Alternatively, the user-entered text could be rendered directly by the design tool(s) 235 executing in the client browser.

In an embodiment, the design tool(s) 235 made available to the user via the customer's browser may allow the customer flexibility in positioning the text and graphic components of the engraving design. For example, the design tool(s) 235 made available to the user may allow the user to change the font of the text or move the text and/or graphic components of the design around within the targeted engraving area of the article. Since in the exemplary embodiment each of the text and graphic components that make up the design template are separate <XML>-defined components, user edits to any of the components is easily performed and the final composite design (i.e., <XML> document defining the customer's engraving design) is easily updated.

Figure 4E:
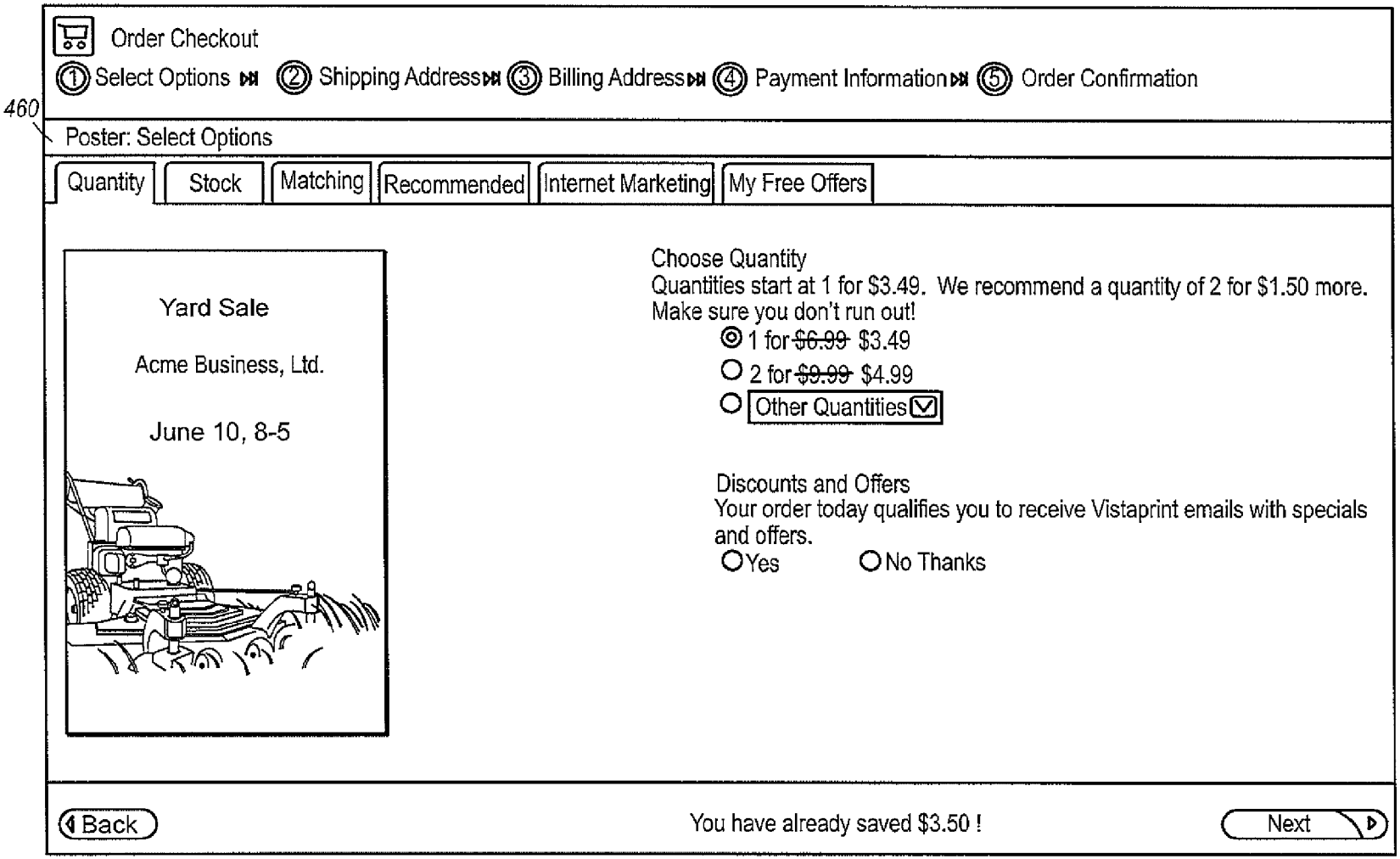

Once the user is satisfied with the design, the user may be presented with a checkout process, for example as begun in FIG. 4E. Web-based checkout procedures are well-known in the art.

Figure 5:
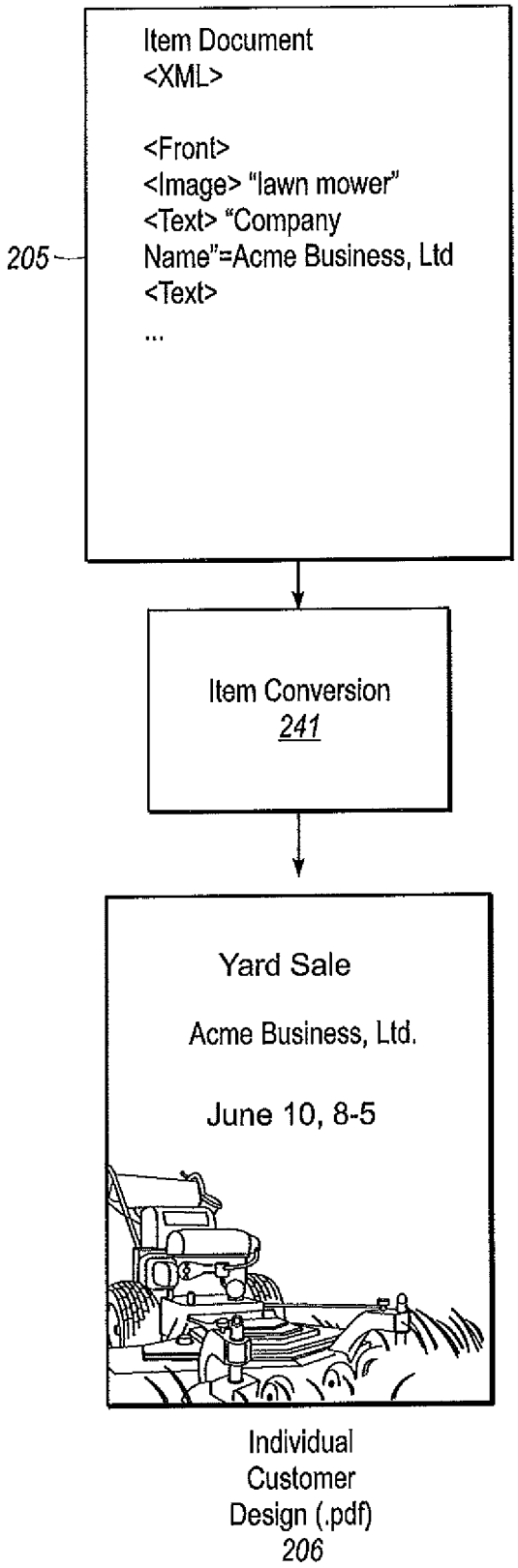
FIG. 5 is a diagram illustrating the conversion of a customized browser-renderable document into a postscript individual engraving design file.

FIG. 5 diagrammatically represents an exemplary embodiment of the operation of the item conversion software 241. In this embodiment, the item conversion software 241 receives an item document 205 in an XML format, and renders it into an individual design file 206 such as .pdf or other Postscript file.

Returning to FIG. 2, a ganging system 260 executing job aggregation, or "ganging" software 261, automatically aggregates, or "gangs together" respective individual customer design files 206 (e.g., .pdf files) associated with the ordered items to be printed with multiple other printed items that potentially are associated with multiple other different customer orders, to produce a gang file 208. The gang file 208 contains the individual customer designs 206 of multiple different items to be simultaneously processed by the printing system as a composite print job.

A "gang" is a grouping of individual customer's printed product designs that can all be printed together by the printing system to simultaneously print multiple different customer products in a single print job. The process of choosing which individual customer's printed product designs are part of a particular gang is called "ganging." Ganging leads to efficiencies on equipment with high setup costs and low run costs. It spreads the setup cost of a print-and-cut job across many orders.

Gangs are generated by the ganging system 260 by filling up gang templates 207. In an embodiment, a gang template is a postscript file such as a .pdf file defining a plurality of pre-positioned empty cells that can be filled with individual postscript files (.pdf) such as individual customer designs 206. Gang templates are stored in non-transitory computer memory 265. The layout of a gang will depend on the type and size of the products to be printed.

Figure 6B:
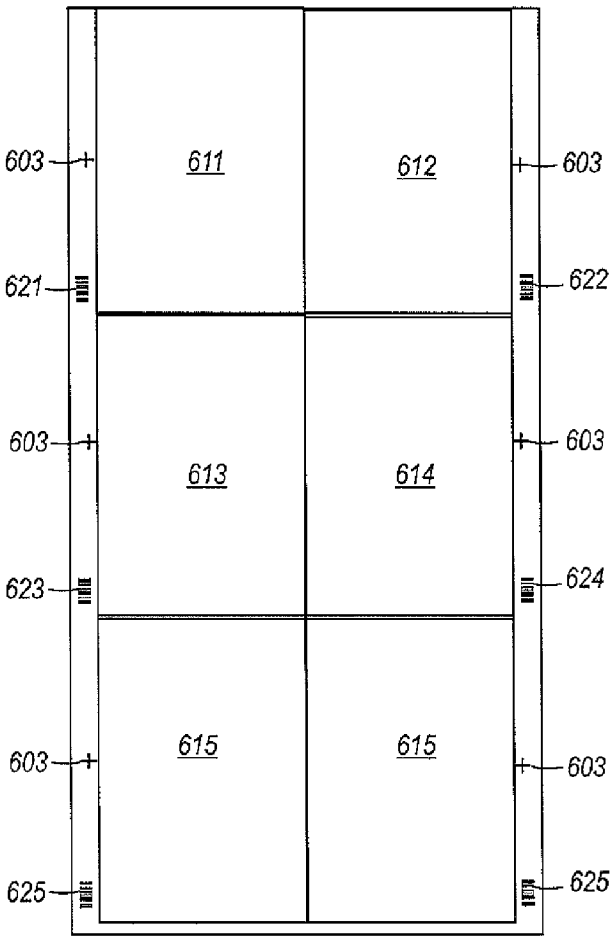
FIGS. 6A and 6B show a poster gang template and a filled gang.
Figure 6A:
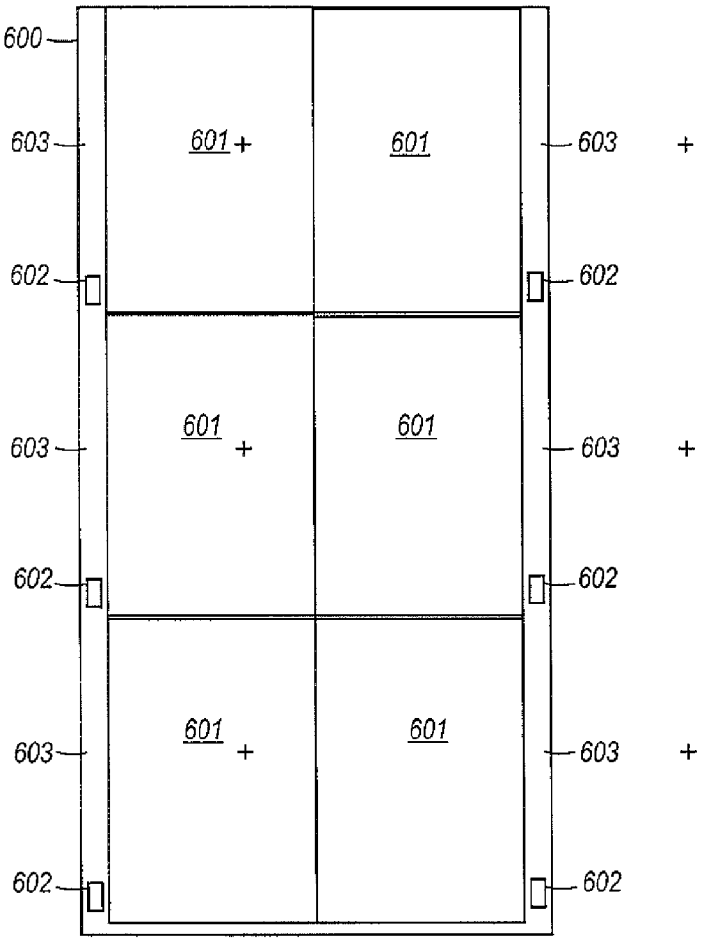

For example, in an embodiment, the products to be printed in a composite print job are posters, which may come in various sizes (e.g., 24×18 inches, 24×36 inches, A1, and A2. In an embodiment, and with reference to FIGS. 6A through 6C, individual item postscript files are arranged in a layout according to a predefined gang template 600. A gang template 600 is a postscript file such as a .pdf file defining a plurality of pre-positioned empty cells 601. For example, FIG. 6A shows a gang template 600 arranged in three rows and 2 columns, and configured to receive six 24×36 inch poster documents. A cell 601 is a content container of pre-defined dimensions corresponding to a product blank and positioned in the gang file layout in a unique pre-defined location in the gang template 600. For example, each cell 601 in the gang template of FIG. 6A has content container dimensions of 24×36 inches. Each empty cell 601 may be filled with a single PostScript item file 611, 612, 613, 614, 615, 616 to be printed. Only PostScript item files for printed items of the same size (e.g., 24×36 inches) can be placed in the same gang. Other gang templates (not shown) are configured to receive poster documents of size 24×18 inches, A1, and A1.

The cells 601 in a gang template 600 are filled according to an automated ganging algorithm, executed within the ganging system 260. The ganging system 260 selects a gang template 600 appropriate to a particular product (e.g., a 24×36 poster) and instantiates a gang template 207 corresponding to the correct product (e.g., a gang for 24×36 inch posters) to create a gang file 208. The ganging system 260 selects individual customer design items scheduled for production and begins filling corresponding cells of the associated gang 208 with the corresponding individual customer design files 206, as illustrated in FIG. 6B.

A gang file 208 is preferably filled to capacity (by filling each cell 801 with individual customer designs (.pdf) 206 of the same type of product) or may only partially fill the gang templates for other reasons (such as meeting critical shipping deadlines when insufficient orders exist to fill an associated gang template). In either case, when the ganging system 260 determines that all items that will be ganged together have been added to the associated gang file 208, the associated gang file 208 is saved. The result is a composite print file 207 to be printed by the printing system 280 onto a large substrate that is subsequently submitted to a cutting system 284 to separate the printed substrate into the individual printed documents corresponding to the individual customer's printed products. In this way, multiple different items that may be associated with multiple different orders and may contain multiple different content and may be simultaneously manufactured.

If the ordered quantity of finished products associated with an item document is more than one, then additional instances of the rendered item graphics PostScript file 611 may be placed in additional cells of the gang template 600 to manufacture the ordered quantity of products. Alternatively, or in addition, additional gang sheets may be printed and cut to manufacture the desired ordered quantity of any given item.

As previously described in conjunction with FIG. 2, the Fulfillment Center Server 240 receives multiple orders for different products from multiple different customers. Each customer's order is potentially a different design with different personalized content. For this reason, each customer's order must be tracked as it is aggregated with other customers' print jobs into a composite print job containing multiple individual customer designs, printed, separated from the printed gang, and packaged and shipped. In order to identify each customer's order, the ganging system generates an identifier 270 for each individual customer product design 206 that is inserted in a gang file 208. In an embodiment, the identifier 270 is a barcode, which when read by subsequent systems later in the production flow, allows the subsequent systems to identify the customer, order, and/or product ID of the printed product. The identifier 270 is inserted into the gang file 208 in predetermined identifier locations 602 associated with each gang cell 601.

The gang file 208 is sent to the printing system 280 (e.g., a printer or a printing press such as an offset press) and printed onto a substrate (such as, but not limited to, a sheet or roll of paper or vinyl) to produce a printed gang sheet 285. The printed gang sheet 285 is then conveyed along a conveyor to a cutting system 284 which cuts the printed gang sheet into individual finished products 286 (e.g., individual printed posters corresponding to individual customers' ordered posters printed with corresponding customer designs). The finished products 286 are sorted by a sorting system 290 into individual customer orders (which may include quantities of 1 or more of the same poster with the individual customer's design and/or additional ordered products). Additional post-print processing, such as affixation of labels or binning an item while waiting for additional items belonging to the order may be performed. The filled orders 291 are then passed by a scanner 292, which reads the barcode on the finished product (s), associates the finished product(s) with the customer, order, and shipping address, and instructs a labeler 294 to generate a label with the customer's shipping address. A packaging system 295 (automated or human) packages the customer's ordered products into the labeled package, and the products are ready to ship or deliver to the respective customers.

Customers of printed products prefer to receive a finished product rather than a product that requires some user effort to complete. When identifiers such as barcodes 621 are printed on the front side of a poster or banner and sent to the customer with the identifier still imprinted thereon, the customer may be less satisfied than if the identifier were affixed on the back or some other non-displayed side of the printed product. In the case of printed posters, it is seemingly more desirable to place the identifiers on the back side of the poster where viewers of the poster do not see the identifier. However, in a printing system which prints on one side only, or which takes additional operator steps to print the back side, other solutions are desired to remove the identifier from the front side and to attach an identifier to the back side.

In accordance with aspects of the invention, at least one scanner 282 and at least one subsequent labeler 283 are placed along a conveyor system between the printing system 280 and cutting system 284. The scanner(s) 282 read the identifiers 621, 622, 623, 624, 625 on the newly printed gang sheet and passes the read information to the Fulfillment Center server 240. The Fulfillment Center server 240 instructs the labeler to print each identifier read by the scanner 282 onto a corresponding label and signals the labeler to affix the label to an area on the underside of the gang sheet corresponding to the back side of the corresponding customer's printed poster as the printed gang sheet is conveyed past the labeler 283.

Figure 7:
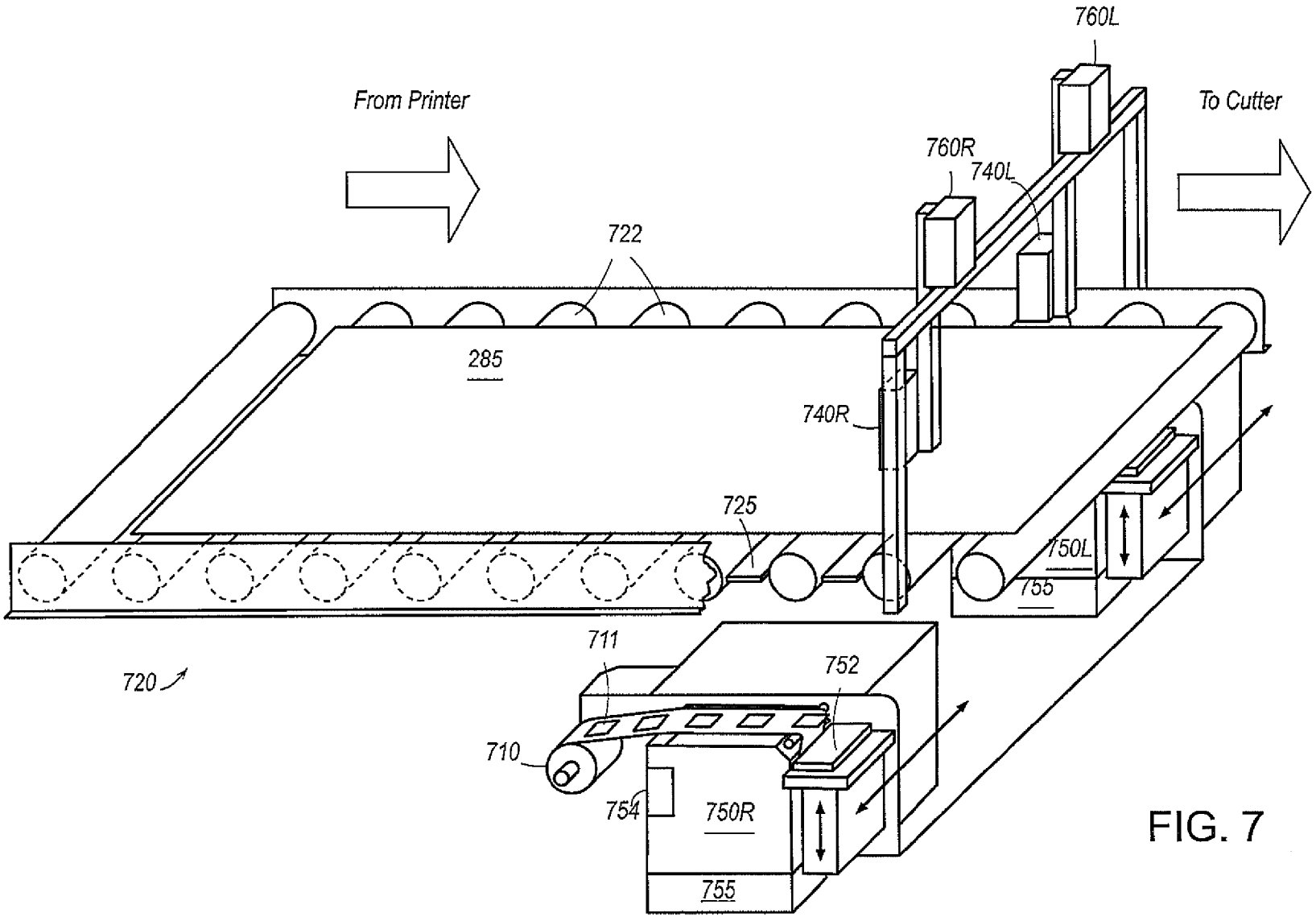
FIG. 7 illustrates an example conveyor system with scan-and-label system.

FIG. 7 shows an exemplary print-and-cut system incorporating scan-and-label functionality in accordance with the features of the invention. As shown in FIG. 7, the system 700 includes a printer (not shown) followed by a conveyor 720 followed by a cutting system (not shown). Two scanners 740L, 740R are mounted above the conveyor 720, one on each of the left and right sides of the center line and parallel to the direction of travel of the conveyor 720. The conveyor includes a plurality of rollers 722 that convey each printed gang sheet 285 output by the printer in the direction of the cutting system 730. Mounted underneath the conveyor are two labelers 750L, 750R, one on each of the left and right sides of the center line and parallel to the direction of travel of the conveyor 720. Labelers 750L and 750R each include a controller 752 which receives label information from a remote device, such as the Fulfillment Center server 240 (FIG. 2). Fulfillment Center server 240 receives a barcode ID from the barcode scanners 740L, 740R, and directs the corresponding labelers 750L and 750R to print the corresponding barcodes onto corresponding labels. Per its instruction, each labeler 750L, 750R prints the barcode corresponding to the barcode ID onto a label, and awaits instruction to apply the label to the under-side of the printed gang sheet.

The printed gang sheets may further be printed with one or more bullseye indicator(s) 603 in predetermined locations on the gang sheet 285 outside the no-trim area. The bullseye indicator(s) 603 are detected by optical positioning detectors 760R, 760L. Detection of the bullseye indicator(s) 603 triggers actuation of the labeler tamper 752, which applies the printed label 711 to the underside of the printed gang sheet 285 in a predetermined position.

As a printed gang sheet 285 exits the printing system, it is conveyed by the conveyor 720 past the barcode scanners 740R, 740L and optical bulleye detector(s) 760R, 760L. A controller (not shown) controls the conveyor and hence the movement of the printed gang sheet 285 past the scanners 740R, 740L and optical bullseye detection system 760R, 760L. When the scanners 740R, 740L detect a barcode 621-625, they read the barcode ID and transmit it to the Fulfillment Center server 240, which then instructs the labeler 750R, 750L corresponding to the scanner to print the barcode onto a label 711 using label printer 754. When the optical bullseye detection system detects a bullseye indicator 603, it sends a signal to the labeler 750L, 750R, which triggers actuation of the labeler tamper 752, which applies the printed label 711 to the underside of the printed gang sheet 285 at a position corresponding to the backside of the corresponding printed poster area on the printed gang sheet (i.e., within the no-trim area of the corresponding gang cell 601).

Figure 8:
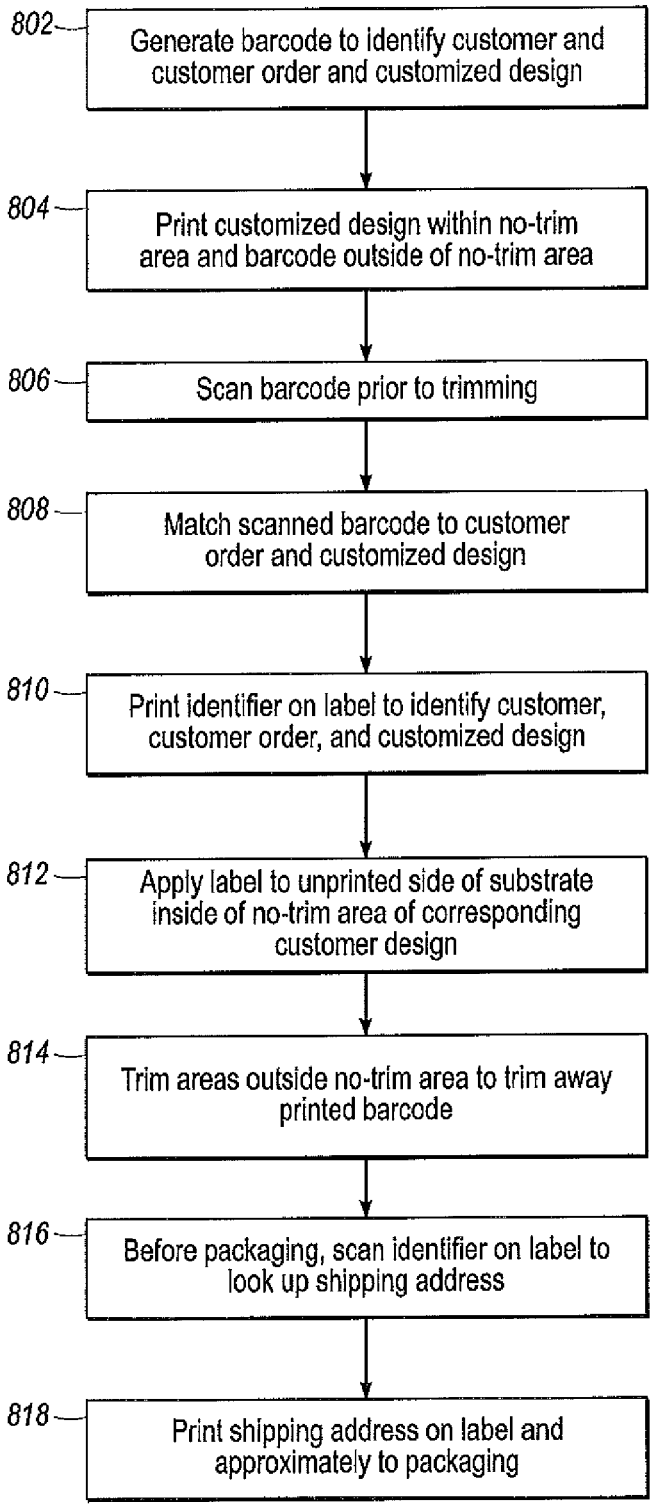
FIG. 8 is a flowchart of an exemplary embodiment for applying customer-specific labels to an unprinted side of printed products.

FIG. 8 is a flowchart detailing an exemplary technique for applying customer-specific labels to an unprinted or non-displayed side of a printed product. In accordance with the inventive features of the embodiments described herein, an individual customer product identifier corresponding to a customer's product design and associated with a customer and customer order is generated (step 802). A customized design specific to the customer order is printed within a no-trim area of a printed product and the individual customer product identifier (for example, in the form of a barcode) is printed outside the no-trim area containing the customer's product design (step 804). In an embodiment, the customer's product design and associated barcode identifier are printed together with a plurality of other customers' product designs and associated barcodes as a composite print job. The printed sheet is conveyed to a cutting system for trimming away the areas of the substrate outside the no-trim areas. Prior to trimming, each barcode is scanned (step 806). The scanned barcodes are matched to customer orders/designs (step 808), and an identifier corresponding to the printed design, customer, and customer order is printed on a label (step 810). In an embodiment, the identifier printed on the label is the same identifier printed on the front side of the sheet which is read by the barcode scanner. The printed label is then applied to the underside (or other non-displayed) area of the printed product (step 812). The areas outside the no-print areas of the sheet are then trimmed away (step 814). In an embodiment, prior to packaging, the identifier on the underside of the printed product is read by a scanner and associated with a customer and customer shipping address (step 816). The customer shipping address is then printed on a shipping label and applied to the packaging of the product(s) (step 818).

In this way, unsightly product identifiers which are specific to a customer and the customer's product design and order, are removed from the front (displayed portion) of the printed product and affixed to a non-displayed area (e.g., the back side) of the printed product.

Figure 9:
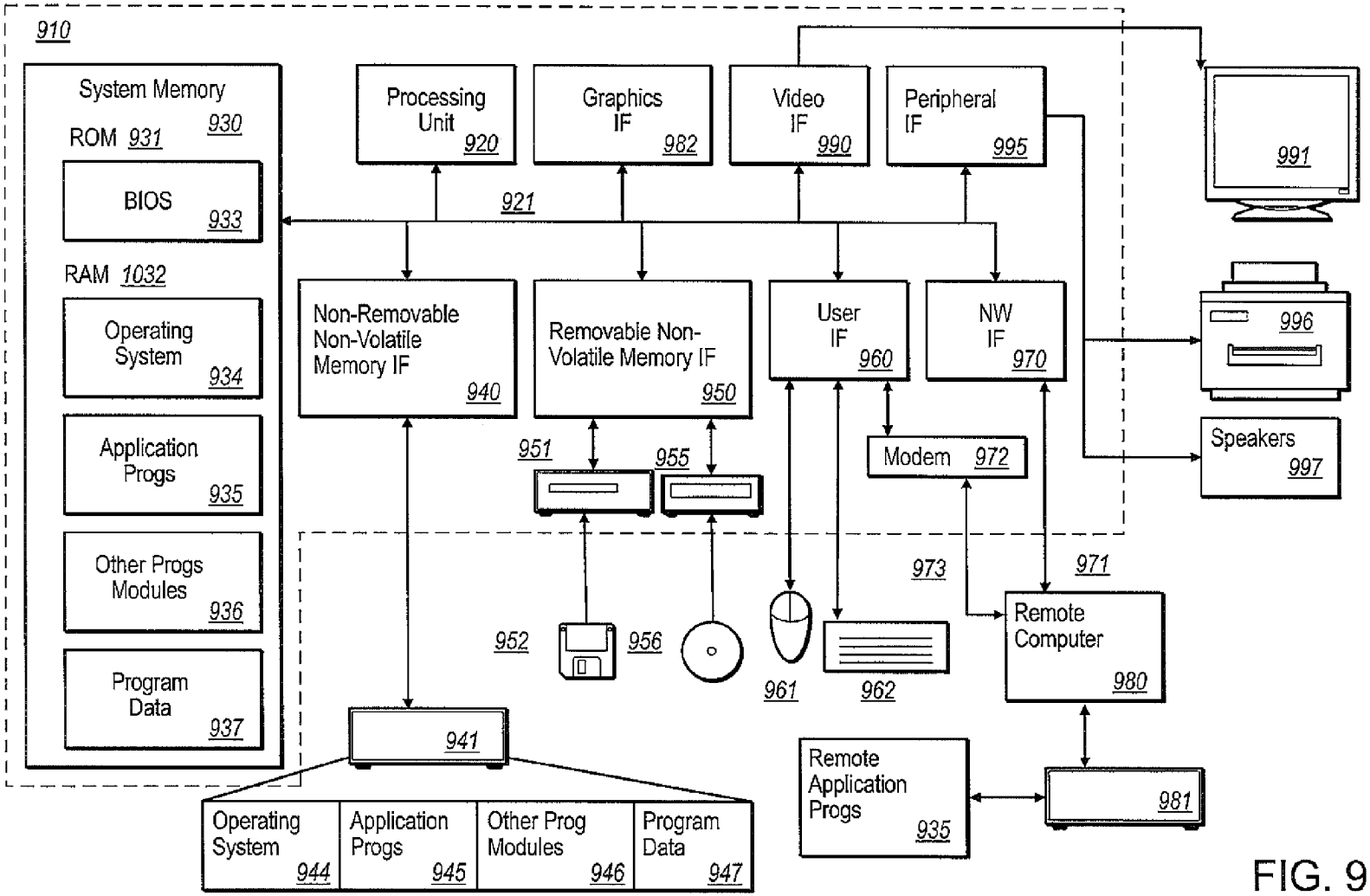
FIG. 9 is a block diagram of a computer system which may be used to implement computing features of the invention.

FIG. 9 illustrates a computer system 910 that may be used to implement any of the servers and computer systems discussed herein. Components of computer 910 may include, but are not limited to, a processing unit 920, a system memory 930, and a system bus 921 that couples various system components including the system memory to the processing unit 920. The system bus 921 may be any of several types of bus structures including a memory bus or memory controller, a peripheral bus, and a local bus using any of a variety of bus architectures.

Computer 910 typically includes a variety of computer readable media. Computer readable media can be any available media that can be accessed by computer 910 and includes both volatile and nonvolatile media, removable and non-removable media. By way of example, and not limitation, computer readable media may comprise computer storage media and communication media. Computer storage media includes volatile and nonvolatile, removable and non-removable media implemented in any method or technology for storage of information such as computer readable instructions, data structures, program modules or other data. Computer storage media includes, but is not limited to, RAM, ROM, EEPROM, flash memory or other memory technology, CDROM, digital versatile disks (DVD) or other optical disk storage, magnetic cassettes, magnetic tape, magnetic disk storage or other magnetic storage devices, or any other medium which can be used to store the desired information and which can accessed by computer 910. Computer storage media typically embodies computer readable instructions, data structures, program modules or other data.

The system memory 930 includes computer storage media in the form of volatile and/or nonvolatile memory such as read only memory (ROM) 931 and random access memory (RAM) 932. A basic input/output system 933 (BIOS), containing the basic routines that help to transfer information between elements within computer 910, such as during start-up, is typically stored in ROM 931. RAM 932 typically contains data and/or program modules that are immediately accessible to and/or presently being operated on by processing unit 920. By way of example, and not limitation, FIG. 9 illustrates operating system 934, application programs 935, other program modules 936, and program data 937.

The computer 910 may also include other removable/non-removable, volatile/nonvolatile computer storage media. By way of example only, FIG. 9 illustrates a hard disk drive 940 that reads from or writes to non-removable, nonvolatile magnetic media, a magnetic disk drive 951 that reads from or writes to a removable, nonvolatile magnetic disk 952, and an optical disk drive 955 that reads from or writes to a removable, nonvolatile optical disk 956, such as a CD ROM or other optical media. Other removable/non-removable, volatile/nonvolatile computer storage media that can be used in the exemplary operating environment include, but are not limited to, magnetic tape cassettes, flash memory cards, digital versatile disks, digital video tape, solid state RAM, solid state ROM, and the like. The hard disk drive 941 is typically connected to the system bus 921 through a non-removable memory interface such as interface 940, and magnetic disk drive 951 and optical disk drive 955 are typically connected to the system bus 921 by a removable memory interface, such as interface 950.

The drives and their associated computer storage media discussed above and illustrated in FIG. 9 provide storage of computer readable instructions, data structures, program modules and other data for the computer 910. In FIG. 9, for example, hard disk drive 941 is illustrated as storing operating system 944, application programs 945, other program modules 946, and program data 947. Note that these components can either be the same as or different from operating system 934, application programs 935, other program modules 936, and program data 937. Operating system 944, application programs 945, other program modules 946, and program data 947 are given different numbers here to illustrate that, at a minimum, they are different copies. A user may enter commands and information into the computer 910 through input devices such as a keyboard 962 and pointing device 961, commonly referred to as a mouse, trackball or touch pad. Other input devices (not shown) may include a microphone, joystick, game pad, satellite dish, scanner, or the like. These and other input devices are often connected to the processing unit 920 through a user input interface 960 that is coupled to the system bus, but may be connected by other interface and bus structures, such as a parallel port, game port or a universal serial bus (USB). A monitor 991 or other type of display device is also connected to the system bus 921 via an interface, such as a video interface 990. In addition to the monitor, computers may also include other peripheral output devices such as speakers 997 and printer 996, which may be connected through an output peripheral interface 990.

The computer 910 may operate in a networked environment using logical connections to one or more remote computers, such as a remote computer 980. The remote computer 980 may be a personal computer, a server, a router, a network PC, a peer device or other common network node, and typically includes many or all of the elements described above relative to the computer 910, although only a memory storage device 981 has been illustrated in FIG. 9. The logical connections depicted in FIG. 9 include a local area network (LAN) 971 and a wide area network (WAN) 973, but may also include other networks. Such networking environments are commonplace in offices, enterprise-wide computer networks, intranets and the Internet.

When used in a LAN networking environment, the computer 910 is connected to the LAN 971 through a network interface or adapter 970. When used in a WAN networking environment, the computer 910 typically includes a modem 972 or other means for establishing communications over the WAN 973, such as the Internet. The modem 972, which may be internal or external, may be connected to the system bus 921 via the user input interface 960, or other appropriate mechanism. In a networked environment, program modules depicted relative to the computer 910, or portions thereof, may be stored in the remote memory storage device. By way of example, and not limitation, FIG. 9 illustrates remote application programs 985 as residing on memory device 981. It will be appreciated that the network connections shown are exemplary and other means of establishing a communications link between the computers may be used.

The system and techniques just described have several advantages. First, multiple articles of manufacture may be engraved in a single engraving job, resulting in savings of time and operator attention for loading and unloading articles of manufacture into the engraving station for engraving. Second, the articles can be engraved through transparent packaging so that the articles need not be removed from their packaging prior to engraving, saving time, cost, and materials.

Those of skill in the art will appreciate that the invented method and apparatus described and illustrated herein may be implemented in software, firmware or hardware, or any suitable combination thereof. Thus, those of skill in the art will appreciate that the methods and systems described herein may be implemented by one or more processors executing computer-readable instructions being stored for execution on one or more computer-readable media. Alternative embodiments are contemplated, however, and are within the spirit and scope of the invention.

Although this preferred embodiment of the present invention has been disclosed for illustrative purposes, those skilled in the art will appreciate that various modifications, additions and substitutions are possible, without departing from the scope and spirit of the invention as disclosed in the accompanying claims.

What is claimed is:

1. A method for producing a printed product and labeling an unprinted side of the printed product, comprising:

receiving a first identifier, the first identifier corresponding to a customer's customized product design and associated with a customer order, the customer order identifying at least a shipping address;

printing the customer's customized product design in a no-trim area on a first side of a substrate;

printing the first identifier associated with the customer's customized product design on the substrate in an area outside the no-trim area;

prior to trimming the area outside of the no-trim area away so that the remaining no-trim area of the substrate generates a finished product, scanning the first identifier and printing a corresponding label containing a second identifier, the second identifier associated with the customer order and comprising information from which the shipping address can be determined, and affixing the label to a different side of the substrate within the no-trim area of the printed design; and trimming the area outside of the no-trim area away so that the remaining no-trim area of the substrate generates a finished product containing the customer's customized product design on the first side of the substrate and the second identifier on the different side of the substrate.

2. The method of claim 1, wherein at least one of the first identifier and the second identifier is a barcode.

3. The method of claim 1, wherein the second identifier is identical to the first identifier.

4. The method of claim 1, wherein the first identifier and the second identifier are identical barcodes.

5. The method of claim 1, further comprising:

scanning the second identifier;

looking up the shipping address associated with the second identifier;

generating a shipping address label containing the shipping address;

packaging the customer's finished product into a package; and affixing the shipping address label to the package.

6. The method of claim 4, wherein the second identifier is identical to the first identifier.

7. A labeling system for producing a printed product and labeling an unprinted side of the printed product, comprising a conveyance system which receives a printed substrate and conveys the printed substrate along a path, the printed substrate comprising a no-trim area printed on a first side of the substrate with a customer's printed design and a trim area outside of the no-trim area which is to be trimmed from the substrate so that the remaining no-trim area of the substrate generates a finished product, the trim area comprising a first identifier printed on the first side of the substrate, the first identifier associated with a customer's customized product design and associated with a customer order, the customer order associated with at least a shipping address;

at least one scanner mounted along the conveyance path which scans the first identifier as the printed substrate is conveyed along the conveyance path;

at least one labeler which generates a label based on the scanned first identifier, the label containing a second identifier associated with the customer order and comprising inform from which the shipping address can be determined, and applies it to the printed substrate within the no-trim area on a side different than the first side of the substrate;

a controller which, based on the scanned first identifier, instructs the at least one labeler to generate the label to contain a second identifier associated with the customer order and comprising information from which the shipping address can be determined, and to apply the label to the non-trim area on the side different than the first side of the substrate on the product; and a trimming system which trims away the area outside of the no-trim area so that the remaining no-trim area of the substrate generates a finished product containing the customer's customized product design on the first side of the substrate and the second identifier on the different side of the substrate.

8. The system of claim 7, wherein the first identifier and the second identifier are identical.

9. The system of claim 7, further comprising:

at least one label reader which reads the second identifier on the label of the finished product;

a controller which determines a shipping address associated with the customer order associated with the read second identifier; and a shipping address label generator which receives the determined shipping address from the controller and prints a shipping address label containing the shipping address for affixation onto a package containing the finished product.

10. The method of claim 5, wherein the first identifier and the second identifier are identical barcodes.

11. The system of claim 7, wherein the first identifier and the second identifier are identical barcodes.

* * * * *